US006791538B2

(12) United States Patent
Van Vugt

(10) Patent No.: US 6,791,538 B2
(45) Date of Patent: Sep. 14, 2004

(54) METHOD AND SYSTEM FOR OPERATING A COMBINATION UNIFIED MEMORY AND GRAPHICS CONTROLLER

(75) Inventor: Henricus Antonius Gerardus Van Vugt, Eindhoven (NL)

(73) Assignee: Siemens AG, Frankfurt (DE)

( * ) Notice: Subject to any disclaimer, the term of this patent is extended or adjusted under 35 U.S.C. 154(b) by 161 days.

(21) Appl. No.: 09/955,649

(22) Filed: Sep. 18, 2001

(65) Prior Publication Data

US 2002/0033812 A1 Mar. 21, 2002

(30) Foreign Application Priority Data

Sep. 18, 2000 (EP) ..... 00120374

(51) Int. Cl.[7] ..... G09G 5/399
(52) U.S. Cl. ..... 345/204; 345/540
(58) Field of Search ..... 345/204, 512, 345/521, 112, 113, 116, 539, 540, 541, 544, 545, 546, 547; 701/1; 711/54

(56) References Cited

U.S. PATENT DOCUMENTS 5,512,921 A 4/1996 Mital et al.
5,854,637 A * 12/1998 Sturges ..... 345/542
5,961,617 A 10/1999 Tsang
6,122,715 A * 9/2000 Palanca et al. ..... 711/154
6,434,450 B1 * 8/2002 Griffin et al. ..... 701/1

FOREIGN PATENT DOCUMENTS

EP 0 645 691 A2 9/1994
EP 0 720 138 A2 12/1995

* cited by examiner

*Primary Examiner*—Vijay Shankar
*Assistant Examiner*—Nitin Patel
(74) *Attorney, Agent, or Firm*—Mayer, Brown, Rowe & Maw LLP

(57) ABSTRACT

A display-based system is disclosed with a processing unit, a memory control facility, and a graphics display controller interfacing to a display facility. Collectively these modules are interconnected by a bus facility to an external memory facility. The graphics display controller has a first mode providing a video image signal to the display facility. In particular, a detector is provided for detecting display stabilization. An output of the graphics display controller is being coupled to a frame grabber. The frame grabber is arranged to execute a writeback-to-memory storage of the video image signal into a writeback image memory during a subsequent videoframe, and subsequently signaling the graphics display controller to switch over to a second mode, in which the stored writeback video image signal is supplied to the display facility. The average data traffic on the bus facility is thus reduced.

15 Claims, 3 Drawing Sheets

FGRB

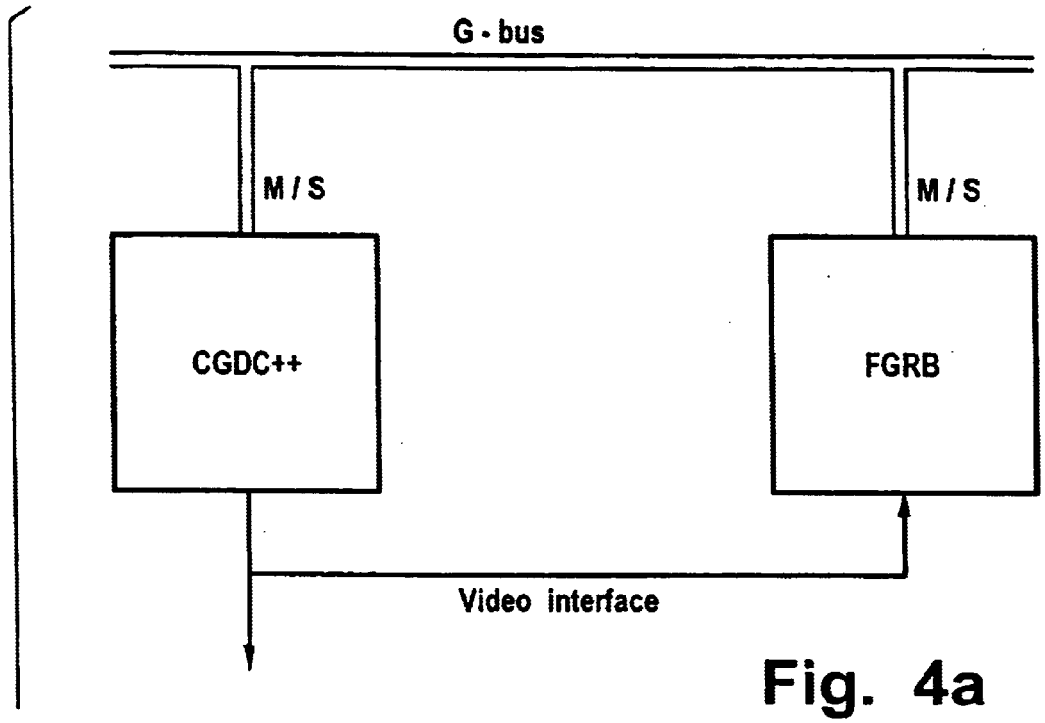
Fig. 4a
Fig. 4
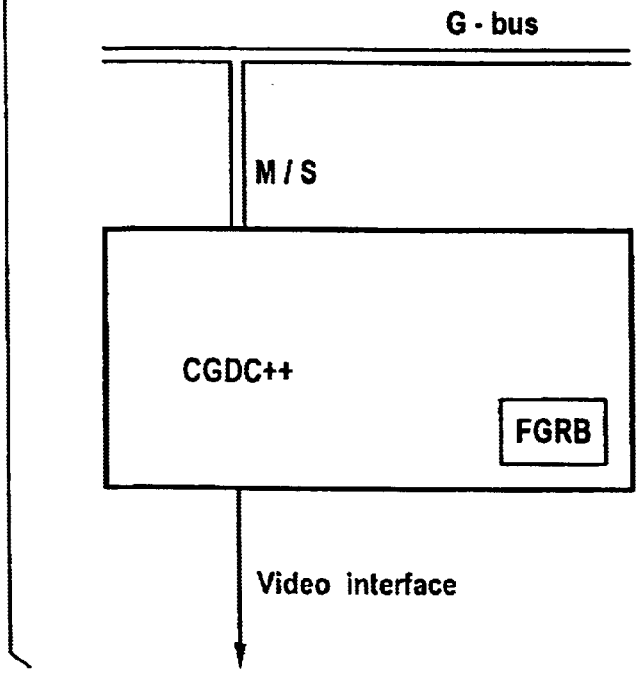
Fig. 4b

METHOD AND SYSTEM FOR OPERATING A COMBINATION UNIFIED MEMORY AND GRAPHICS CONTROLLER

FIELD OF INVENTION

This invention relates to a method and system for operating a combination unified memory and graphics controller. More specifically, the invention relates to a system which only writes back a video image on a bus when the image is changed.

BACKGROUND OF INVENTION

In current display driver configurations, the processing unit or processor and graphics display controller jointly operate on a single external memory facility, e.g. DRAM, through using the associated DRAM controller in common. This method is known as a unified memory approach and represents an extremely cost-effective solution through its limited number of components and pins.

However, with advancing display sophistication, represented by a higher number of bits per pixel, a higher number of map planes underlying a composite picture and the demand for an ever greater image resolution, in combination with a high refresh rate such as 50 or 60 times per second, raises the amount of bus-traffic necessary for maintaining the displayed image. In fact, requirements may go up to 8-bit pixels, using at least two overlay planes, and full VGA support. Without additional measures, the unified memory concept would be ruined through the incurred rise in bus traffic. Depending on the architecture chosen, the peak values of the bus load may be acceptable but the average bus load is expected to be excessively high.

By itself, frame grabbing is well-known, such as recited in U.S. Pat. No. 5,798,798 for simultaneously acquiring video images and analog signals, and U.S. Pat. No. 6,023,522 for fingerprint acquisition. However, such frame grabbing occurs for every frame of a signal sent to a display.

Thus, there is a need to maintain the advantages of unified memory while still restricting the incurred bus load to an acceptable level. There is also a need for a system where frame grabbing is applied where the image source may have its contents remain steady for relatively long intervals and the changes will occur only intermittently.

SUMMARY OF THE INVENTION

These needs and others may be met by the present invention which is embodied in an interface between various electronic subsystems that are mutually coupled through a bus facility for a display-based system. These subsystems include at least a processing unit, a memory control facility, a graphics display controller, and an external memory facility. These subsystems are collectively interconnected by a bus facility to the external memory facility. The processing unit, the memory control facility, the graphics display controller, and as the case may be, various other peripherals are joined into a single integrated circuit module. Particularly, the graphics display controller interfaces to a display facility, and has a first mode supplying the display facility a video image signal having at least one overlay plane. According to one aspect a detector is provided for detecting display stabilization and an output of the graphics display controller is coupled to a frame grabber. The frame grabber is configured for executing a writeback-to-memory storage of the video image signal into a writeback image memory during a subsequent video frame, and subsequently signaling the graphics display controller to switch over to a second mode. In the second mode, the stored writeback video image signal is supplied to the display facility for display.

The video image signal in the above display system may remain unchanged during considerable time periods. The writeback-to-memory storage of the video image signal and the signaling of a change in the video image signal to be displayed allows updating the stored writeback image only when the image changes and therefore greatly reduces the bus load compared with the prior art systems. The system has all data necessary to display the image continuously available.

A further considerable reduction of the bus load is obtained in a preferred embodiment of the system according to the invention, where the frame grabber is arranged for on-the-fly compacting coding of the video image signal into an encoded writeback video image signal. The graphics display controller includes a decoding facility for decoding an encoded writeback video image signal prior to the display thereof.

Preferably, run-length encoding is being used to effect compacting or data compression of the video image signal prior to the writeback-to-memory storage.

The detector is preferably also arranged for signaling the graphics display controller to switch over from the second mode to the first mode at a change in the video image signal to be displayed.

Another preferred embodiment of the above system according to the invention which allows for a cost effective implementation has a single integrated circuit containing the processing unit, memory control facility and display controller.

A particular embodiment features separate application and memory management facilities, each having a respective processor, a set of two memory controllers, a graphics display controller, and a block of peripheral modules. While the processing oriented architecture has been doubled in this system, the memory remains singular.

The invention also relates to a method for operating a display-based system that has various subsystems including at least a processing unit, a memory control facility, and a graphics display controller interfacing to a display facility. The graphics display controller has a first mode providing a video image signal to the display facility. These subsystems are collectively interconnected by a bus facility to an external memory facility.

A method according to the invention is characterized by generating a screen stable signal when display stabilization is detected, and having the frame grabber subsequently execute a writeback-to-memory storage of the video image signal into a writeback image memory. The graphics display controller is subsequently signaled to switch over to a second mode, in which the stored writeback video image signal is supplied to the display facility for display.

In a preferred embodiment the busload is further decreased by the writeback-to-memory storage applying to a single video overlay plane.

Preferably, this method according to the invention includes making the screen stable signal inactive upon entering a graphics handler procedure, and letting it return to active upon exiting the graphics handler procedure. This measure allows for a simple software implementation.

For reliable signaling of the graphics display controller to switch over to the stored writeback image for display, the screen stable signal is determined by calculating a video check sum at an output of the graphics display controller.

Furthermore, the screen stable signal is preferably determined through monitoring CPU accesses to memory regions that contain video data currently displayed.

In another preferred method, the writeback-to-memory storage is executed during a succession of a plurality of frame intervals, for constituting a single image.

The graphics display controller switches between the first and second modes during a vertical video signal blanking interval to avoid switching actions from becoming noticeable (e.g. in a flickering of the displayed image). Further features of the invention are recited in the dependent claims.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF DRAWINGS

These and further aspects and advantages of the invention will be discussed more in detail hereinafter with reference to the disclosure of preferred embodiments, and in particular with reference to the appended Figures that illustrate:

FIGS. 4*a*–4*b* are two alternative setups for implementing the present invention.

DESCRIPTION OF THE PREFERRED EMBODIMENT

Figure 1:
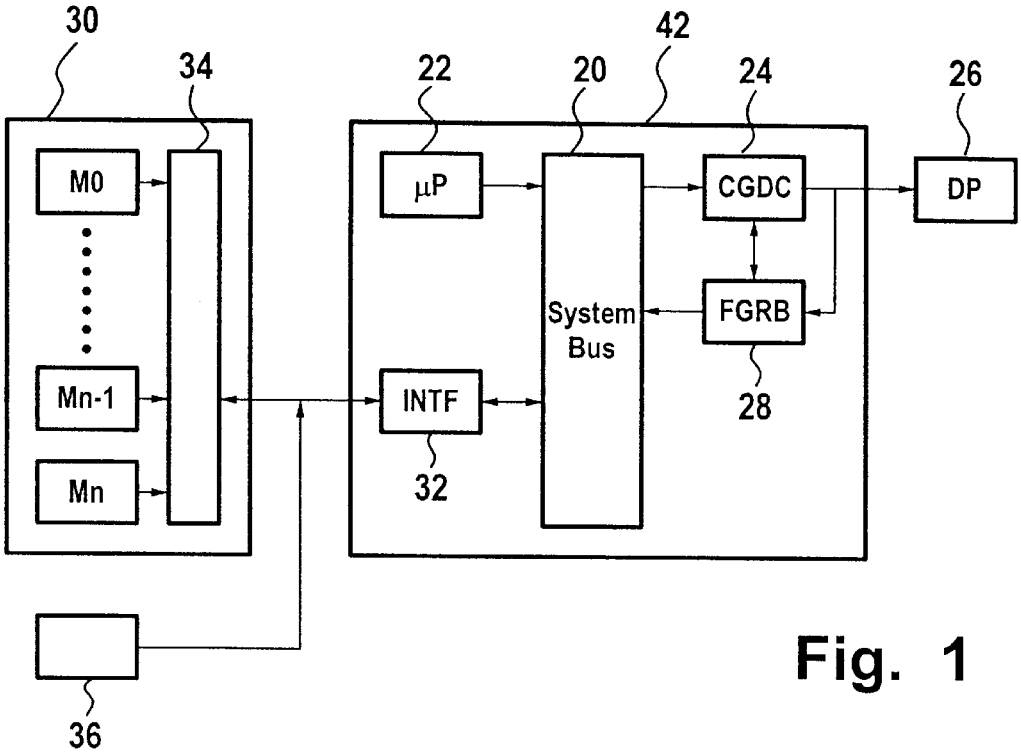
FIG. 1 is a block diagram of a comprehensive bus-based processing system according to the invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

FIG. 1 is a block diagram of a comprehensive bus-based processing system. Without express or implied limitations, the system of FIG. 1 is an example which is intended for use in a car navigation application where a driver receives traveling advice based on various data sources that may include a static road map, the dynamic travel of the vehicle in question, short-time disruptions such as road jams, work in progress and the like, driver preferences, vehicle servicing and refueling requirements and various other categories. Also various other data handling facilities may be offered, such as that pertaining to loading/unloading of the vehicle, theft monitoring, fleet management, and a host of other applications.

In the simplified system shown in FIG. 1, all modules are centered around a bus facility 20. The surrounding modules include a processing unit 22, a graphics display controller 24, a display facility 26 and a frame grabber 28. The graphics display controller 24 has a first mode providing a video image signal to the display facility 26. The frame grabber 28 has an input coupled to an output of the graphics display controller 24 and an output coupled to the bus facility 20. The graphics display controller 24 and the frame grabber 28 are mutually interconnected to arrange for operation in a first and a second mode, which will be explained below. An external memory facility 30 and further peripheral modules grouped into block 36 are being coupled through an interface 32 to the bus facility 20.

The external memory facility 30 includes various memory storage units, M0 to Mn−1, which in this example represent a CD player (e.g. for map storage), various ROMs and RAMs for storage of various image features, such as image overlay planes, as well as a writeback image memory, Mn. The memory storage units M0 to Mn are coupled via a memory management facility 34 and the interface means 32 to the bus facility 20. The memory management facility 34 functions to manage the video data flow between the memory storage units M0 to Mn and the other modules surrounding the bus 20. The further peripheral modules that are included in block 36 may encompass external video sources (not shown) which may be an MPEG decoder producing a YUV signal, an YUV to RGB converter, a video switch and the like, physical sensors, GPS receiver, driver panel facilities, remote data paths, test interface, and many others as required. By and large, car navigation and information systems have been commercially available from various manufacturers, such as Mannesmann VDO A.G. of Germany.

The solution according to the invention for effectively reducing the bus traffic load is to introduce a separate facility for generating a software-controlled signal at the instant it is detected that the contents of the video signal displayed on the display screen have become stable. The occurrence of display stabilization is detected by a detector included in the processing unit 22. The detector may be implemented in software and is therefore not shown separately in FIG. 1. This software-controlled signal, hereinafter also being referred to as "screen stable" signal, will remain suspended until the start of a new video frame. During a new video frame, all data that comes out of the graphics display controller 24 and constitutes an image will be written back through the frame grabber 28 to the writeback image memory Mn. This operation is hereinafter also referred to as "image grabbing." The image grabbing is preferably executed while applying on-the-fly encoding. Eventually, the frame grabber 28 will signal the graphics display controller 24 to a second mode which is the switch-over to reading the new (encoded) image from the writeback image memory Mn. The graphics display controller 24 uses internal logic such as that belonging to one of the actual overlay planes to display the "grabbed" image, and will keep doing so until the software signals that the video signal contents displayed on the screen, hereinafter also being referred to as "screen contents," are about to change again. The detection and signaling of the upcoming change of the video image signal is provided by the software detector, included in the processing unit 22 and is followed by a switch over from the second mode into the original or first mode, in which the original real time video image signal is displayed.

Since the screen contents will be stable most of the time, it follows that the above system will lead to a dramatic reduction of the average bus load. A first improvement is caused by compacting the video image signal prior to the write back storage in the write-back image memory Mn and by reading out of the encoded write-back video image signal from the write-back image memory Mn. Preferably run length encoding is applied, which in practice, will result in a greater compression factor for graphics and textual images than for images that may contain photographic material. A second traffic reduction is achieved when only reading a single overlay "plane" at the refresh frequency of 50/60 $sec^{-1}$, rather than the whole plurality of those planes.

A simple implementation of generating the "screen stable" signal is by making it inactive upon entering the "graphics handler" module, and letting it return to active upon exiting the handler. Various possible implementations have had a similar signal available already.

Another implementation is generating the "screen stable" signal in hardware.

This may be done in various ways. One is by monitoring CPU accesses to memory regions that contain video data which are currently displayed and noting that any write access to these regions may lead to the screen being unstable. However, this solution may require an appreciable amount of compare logic for checking whether a write action to a certain address may influence the screen contents.

Another implementation is by calculating a "video frame checksum" at the output of the graphics display controller, inasmuch as a change in the checksum will indicate that the screen is "unstable." This second solution requires separate logic for displaying the "grabbed" image, otherwise a deadlock might occur. The disclosure hereinafter will focus on this second implementation, but persons skilled in the art will recognize the alternatives as similarly feasible. As an alternative to the run-length encoding feature described in the embodiment hereinafter, other redundancy-diminishing coding methods may be used as well.

Advantageously, the switching over to the "grabbed" image is effected during a vertical video signal blanking interval of a displayed image, but various alternatives will be recognized by persons skilled in the art of video image control.

The control signals will be output next to the actual video data from the graphic display controller 24 and various control signals will be required to allow writing an image back to memory that should be displayed on screen with an identical viewing look.

Figure 2:
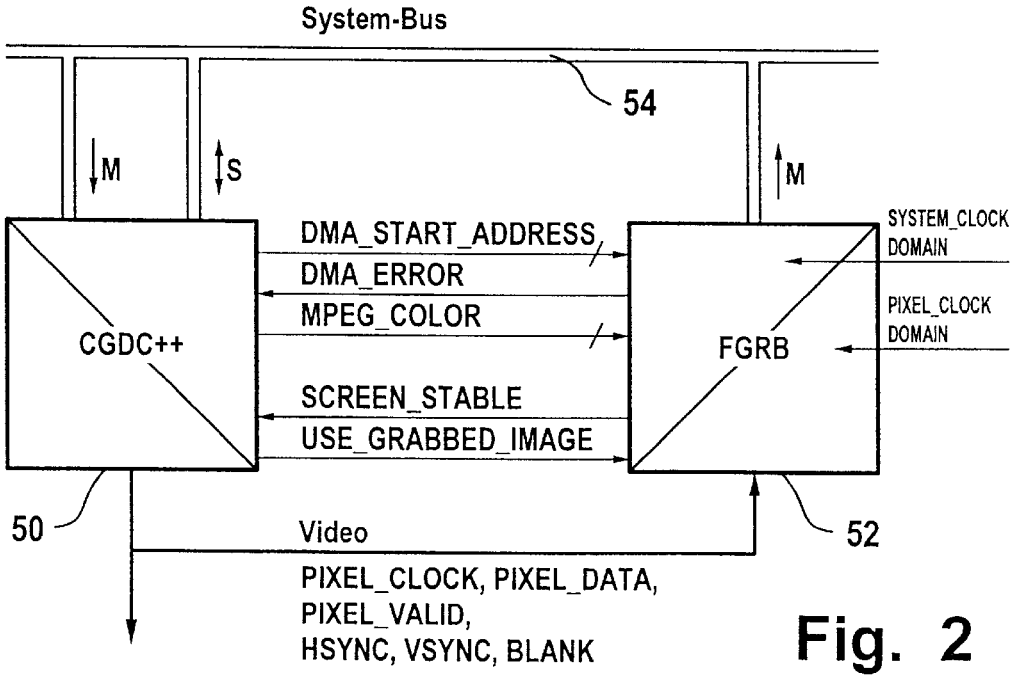
FIG. 2 is a block diagram of the graphics display controller and frame grabber arrangement of the system shown in FIG. 1.

FIG. 2 illustrates a comprehensive graphics display controller (CGDC++)/frame grabber (FRGB) arrangement for use with the present invention. The controller includes a graphics display controller module 50 and a frame grabber module 52. The graphics display controller module 50 connects to a system bus 54 through a master interface M for effecting DMA transfer. The display controller module 50 is also connected through a slave interface S which is parallel to the master interface M for providing the module with settings and for reading back status information. The various data flow directions have been indicated by arrows in FIG. 2. As shown, the frame grabber module 52 interfaces to the system bus 54 through a master interface only. Furthermore, it will receive the necessary setting information immediately from the graphics display controller module 50, for limiting the amount of logic required in the preferred implementation.

In the preferred embodiment, the setting information has been indicated as follows:

DMA_START_ADDRESS (a multibit signal) is the memory start address where the frame grabber module 52 will commence storing the grabbed image once the screen will have become stable. The same address is the readout start address for the control module when the frame grabber module 52 signals the graphics display controller module 50 to switch-over to the grabbed image.

MPEG_COLOR (a multibit signal) is used for color control. Generally, the graphics display controller 50 will produce 15-bits PIXEL_DATA (RGB555) associated with a PIXEL_VALID indication bit. The latter controls a screen region to contain external video signals, which may be compressed through video signal compression algorithms, such as MPEG, and/or for effecting picture-in-picture display. However, the PIXEL_VALID indication becomes inactive when the color of the "overlay plane" will match a particular preprogrammed color value. The PIXEL_VALID can be connected to an external video switch not shown. To preserve the PIXEL_VALID information, the frame grabber module 52 can translate invalid pixels into pixels that have MPEG_COLOR. When the graphics display controller 50 switches over to the grabbed image, the same pixels will become invalid as before.

SCREEN_STABLE is the control signal which indicates whether actual screen contents are stable or not. No additional time requirements exist for this signal. When the signal SCREEN_STABLE goes inactive, the frame grabber module 52 will go into reset state, and no further frame grabber DMA transfers will take place. Finally, the signal USE_GRABBED_IMAGE (see below) from the frame grabber module 52 to the graphics controller 50 will become inactive.

Signals returning from the frame grabber module 52 to the controller module 50 include:

DMA_ERROR: when the frame grabber module 52 encounters an error while doing DMA accesses, it will pass on this information to the graphics controller 50. The graphics controller 50 possesses all necessary interrupt registers and associated logic to handle the associated interrupt.

USE_GRABBED_IMAGE: this signal is used inside the graphics display controller 50 to control switch-over between the normal operation, and the operation wherein the "grabbed" image will be displayed. This signal may change its value exclusively during a vertical blanking intervals, so that the switching in the graphics display controller 50 can be effected in a straightforward manner, without causing visible disturbances on the screen.

As shown, the graphics display controller 50 will also generate standard video data and control signals (PIXEL_CLOCK, PIXEL_DATA, PIXEL_VALID, HSYNC, VSYNC, BLANK) that are communicated to the frame grabber module 52 as well as to all other subsystems (not shown) which need the information in question. Finally as indicated, both the graphics display controller 50 and the frame grabber 52 have respective system clock domains, as well as pixel clock domains. Data will be passed from one clock domain to the other inside the FIFO contained in the frame grabber 52 for decoupling the video data rate from the system bus data rate, as will be discussed in detail hereinafter. This decoupling is mandated because there is no guarantee that an incoming pixel will be written to memory immediately, especially, because the frame grabber 52 will usually have the lowest priority level on the system bus. This serves to avoid disturbing bus operations by the graphics display controller 50, and if appropriate, the operations by other master modules (not shown). Bus latency could otherwise become a problem for such master modules. In fact, even as the frame grabber 52 may have actual bus control and is busy executing write transfers to memory, it will release such control when any master module requests the bus.

The low priority level of the frame grabber 52 with respect to other prospective bus masters may cause the complete storage of a whole video image by the frame grabber module 52 to take more than one video frame interval. The effective duration will be determined by various factors such as busload caused by other masters, the compression rate, the FIFO depth, and other effects. However, even when the transfer takes as long a six frame periods, 90% of the time there will nevertheless be brought about as a marked benefit of displaying the "grabbed image," for the 60 frames per second repetition. Whenever the frame grabber 52 detects that its own FIFO is full, it will wait for the start of the next video frame, and subsequently, resume the loading of the FIFO at the video line and pixel where operation had stalled earlier.

If furthermore, for any reason the use of the frame grabber 52 would not give any benefit, then the software can simply keep the signal SCREEN_STABLE continuously inactive. An example of this would be when the information on the screen is moving continuously.

Figure 3:
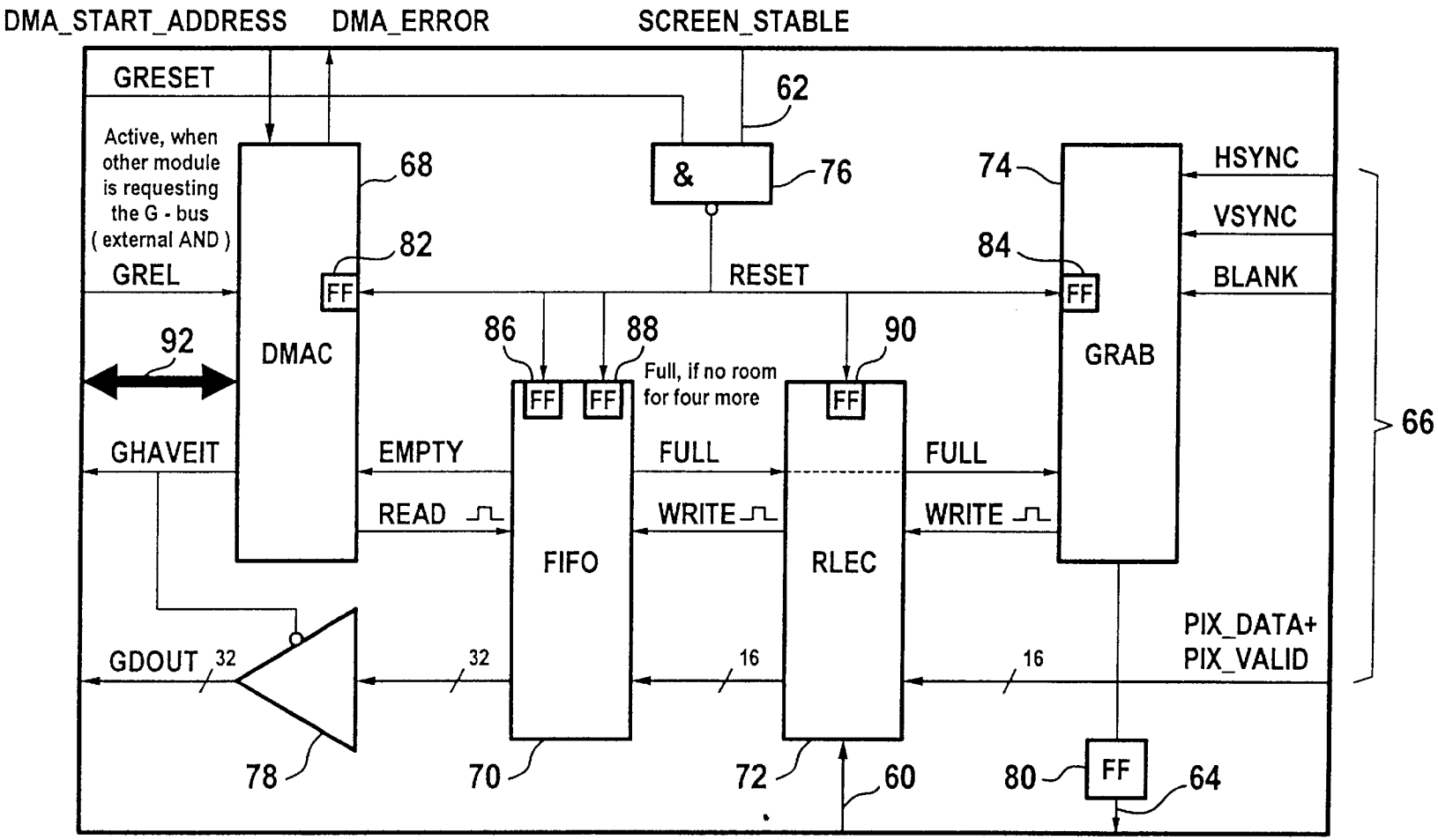
FIG. 3 is block diagram of the frame grabber.

FIG. 3 is a block diagram which illustrates more in detail the frame grabber. The interface to the graphics display controller module 50 through signals 56, 58, 60, 62, 64 has been described above. Also, the video information is indicated by element 66. The SCREEN_STABLE signal 62 will be stored by way of RESET in a DMAC (controller) 68, a FIFO 70, a module RLEC 72, and a GRAB module 74, in their respective flipflops 82, 86 (system clock domain), and 84, 88, 90 (pixel clock domain). The signal 62 that may change at any instant needs synchronization/gating through GRESET and NAND 76 for effect. In contradistinction, if the signal GREL becomes active through eternal ANDING (not shown) by another module requesting use of the G-BUS, the DMA controller is kept transiently inactive. Note bidirectional arrow 92 signaling the associated data/address communication.

As shown, the modules 68, 70, 72, 74 are chained through FIFO full/empty signals that can allow the writing from GRAB, and the reading from DMAC. The associated data flow is a 16 bit wide write and a 32 bit wide read GDOUT, the latter buffered in buffer 78 as controlled by the signal GHAVEIT from the DMAC 68. The FIFO is full when there is no more room for at least 4 samples. The signal GHAVEIT is communicated by the DMAC to the Bus domain. The module 72 receives MPEG_COLOR, in that the PIX VALID inactive is translated into MPEG COLOR. Finally, the GRAB issues a binary USE GRABBED_IMAGE to a REG module by way of the flipflop 80 for controlling appropriate multiplexers; as an initial preference it can change at falling edges of VSYNC.

FIGS. 4*a*–4*b* show two alternative setups for implementing the present invention. The setup in FIG. 4*a* closely follows the arrangement of FIG. 2 but now has both modules interfacing to the GBUS through respectively shared M/S multi-lines. The system in FIG. 4*b* carries integration one step further in that the frame grabber module is an internal module of the CGDC++ unit. Both setups have their respective merits.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A display-based system comprising:

a processing unit (22);

a memory control facility (32, 34);

a display facility (26);

a graphics display controller (24, 50) interfacing to the display facility and having a first mode supplying a video image signal including at least one overlay plane to the display facility;

a bus facility (20) collectively interconnecting the processing unit, the memory control facility, and the graphics display controller to an external memory facility (30);

a detector (22) for detecting display stabilization of the video image signal on the display facility and providing a screen stable signal which remains suspended until a subsequent video frame is supplied;

a frame grabber (28, 52); the writeback image memory (Mn) coupled to the frame grabber; and wherein an output of the graphics display controller (24, 50) is coupled to the frame grabber arranged for executing a writeback-to-memory storage of the video image signal into the writeback image memory (Mn) during a the subsequent video frame, and subsequently signaling the graphics display controller (24, 50) to switch over to a second mode, in which the stored writeback video image signal is supplied to the display facility (26) for display.

2. The system as claimed in claim 1 where the frame grabber (28, 52) is arranged for on-the-fly compact coding of the video image signal into an encoded writeback video image signal, and the graphics display controller (24, 50) includes a decoding facility to arrange for decoding the encoded writeback video image signal prior to the display thereof.

3. The system as claimed in claim 2 wherein the coding is run-length encoding.

4. The system claimed in claim 1 wherein the detector (22) signals the graphics display controller (24, 50) to switch from the second mode to the first mode when a change in the video image signal to be displayed occurs.

5. The system as claimed in claim 1 wherein the processing unit (22), memory control facility (32, 34) and graphics display controller (24, 50) are contained in a single integrated circuit.

6. The system as claimed in claim 1 characterized by a use thereof in a car navigation application.

7. A system as claimed in claim 1 wherein signaling remains suspended until the start of a next video frame.

8. A system as claimed in claim 1 further comprising hardware for effecting signaling.

9. A method for operating a display system having a processing unit (22), a memory control facility (32, 34), and a graphics display controller (24, 50) interfacing to a display facility (26), the processing unit, memory control facility and graphics display controller collectively interconnected by a bus facility (20) to an eternal memory facility (30), the method comprising:

providing a first mode for providing a video image signal from the graphics display controller to the display facility;

generating a screen stable signal at a detection of display stabilization;

receiving the screen stable signal and subsequently executing a writeback-to-memory storage of the video image signal into a writeback image memory (Mn) by frame grabber means (28, 52), upon receipt of the screen stable signal; and signaling the graphics display controller (24, 50) to switch over to a second mode, in which the stored writeback video image signal is being supplied to the display facility (26) for display.

10. The method as claimed in claim 9, wherein the writeback-to memory storage applies to a single video overlay plane.

11. The method as claimed in claim 9 wherein the screen stable signal is made inactive upon entering a graphics handler procedure, and is returned to active upon exiting the graphics handler procedure.

12. The method as claimed in claim 9 further comprising determining the screen stable signal through calculating a video check sum at an output of the graphics display controller (24, 50).

13. The method as claimed in claim 9 further comprising determining the screen stable signal through monitoring CPU accesses to memory regions that contain video data that are currently displayed.

14. The method as claimed in claim 9 wherein writeback-to-memory storage is performed during a succession of a plurality of frame intervals for constituting a single sage.

15. A method as claimed in claim 9 wherein the graphics display controller (24, 50) is switched between the first and second modes during a vertical video signal blanking interval.

* * * * *